United States Patent [19]

Sumi

[11] Patent Number: 4,672,930

[45] Date of Patent: Jun. 16, 1987

[54] DECOMPRESSION APPARATUS FOR ENGINES

[75] Inventor: Kiyohide Sumi, Koga, Japan

[73] Assignee: Fuji Jukogyo Kabushiki Kaisha, Tokyo, Japan

[21] Appl. No.: 855,192

[22] Filed: Apr. 21, 1986

[30] Foreign Application Priority Data

Apr. 25, 1985 [JP] Japan ..... 60-62345[U]

[51] Int. Cl.[4] ..... F01L 13/08

[52] U.S. Cl. ..... 123/182; 123/90.16

[58] Field of Search ..... 123/182, 90.16, 316

[56] References Cited

U.S. PATENT DOCUMENTS 3,362,390 1/1968 Esty ..... 123/182

3,496,922 2/1970 Campen ..... 123/182

FOREIGN PATENT DOCUMENTS 50-7381 3/1975 Japan .

*Primary Examiner*—Andrew M. Dolinar

*Attorney, Agent, or Firm*—Martin A. Farber

[57] ABSTRACT

A decompression apparatus for an engine has a valve releasing lever comprising a shaft and a weight secured to the shaft. The shaft has a large diameter portion, reduced portion formed in the large diameter portion, small diameter portion adjacent the reduced portion. A cam gear formed on a camshaft has a first hole in which the large diameter portion is rotatably mounted, second hole in which the reduced portion and small diameter portion can be inserted, slit connecting both the first and second holes. The slit has a width for allowing the reduced portion of the large diameter portion to pass the slit, whereby the releasing lever is attached to the cam gear by inserting the small diameter portion and reduced portion in the second hole and passing the reduced portion through the slit to engage the large diameter portion with the first hole.

3 Claims, 7 Drawing Figures

DECOMPRESSION APPARATUS FOR ENGINES

BACKGROUND OF THE INVENTION

The present invention relates to a decompression apparatus for an internal combustion engine, designed to make starting of the engine easier.

A decompression device has been known which is either automatically or manually operated to open either an intake valve or an exhaust valve to a small extent to reduce the compression pressure in combustion chambers during starting and thereby to reduce the starting load of the engine. In case of a manual decompression device, opening and closing operations of a decompression valve have to be manually carried out.

On the other hand, Japanese Utility Model Publication No. 50-7381 discloses an automatic decompression device which is operated by the centrifugal force of a weight and automatically reduces pressure in a combustion chamber during the starting of an engine. In the known device, the decompression device has a releasing lever with a weight which projects beyond a periphery of a cam by centrifugal force caused by the rotation of a camshaft. However, it is difficult to assemble such a conventional decompression device, since the releasing lever is provided at a position adjacent the camshaft; and production cost becomes higher because of a complicated shape of the releasing lever which must be changed according to the type of the engine.

SUMMARY OF THE INVENTION

The object of the present invention is to provide a decompression apparatus which may be easily assembled at low cost.

According to the present invention, there is provided a decompression apparatus for an engine having a camshaft, a cam gear formed on the camshaft, a tappet engaging with a cam on the camshaft, and a releasing lever comprising a shaft and a weight secured to the shaft. The shaft has a large diameter portion to which the weight is secured, reduced portion formed in the large diameter portion, small diameter portion adjacent the reduced portion, flat reduced portion formed in an end portion of the small diameter portion. The cam gear has a first hole in which the large diameter portion is rotatably mounted, second hole in which the reduced portion and small diameter portion can be inserted, slit connecting both the first and second holes and having a width for allowing the reduced portion of the large diameter portion to pass the slit. The releasing lever is attached to the cam gear by inserting the small diameter portion and reduced portion in the second hole and passing the reduced portion through the slit to engage the large diameter portion with the first hole.

The other objects and features of this invention will be apparently understood from the following description with reference to the accompanying drawings.

DETAILED DESCRIPTION OF A PREFERRED EMBODIMENT

Figure 1:
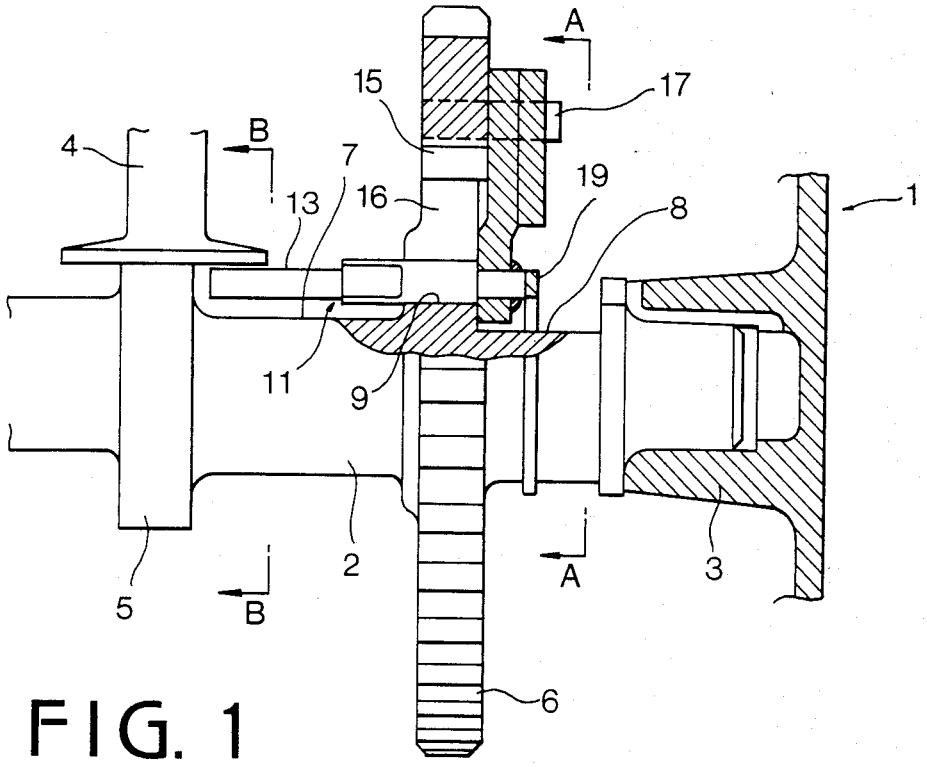
FIG. 1 is a sectional view of a decompression apparatus according to the present invention.

Referring to FIG. 1, a main bearing cover 1 of an engine has a bearing 3 which supports one end of a camshaft 2, the other end of which is supported by another bearing (not shown). A cam 5 is formed on the camshaft 2 in a position corresponding to a tappet 4 for an intake or exhaust valve. Further formed on the camshaft 2 between the cam 5 and the bearing 3 is a cam gear 6 which is engaged with a gear of a crankshaft (not shown).

Recesses 7 and 8 each having a flat bottom are formed on the camshaft 2 by cutting away a portion of the periphery of the camshaft between the cam 5 and the cam gear 6, and a portion between the cam gear 6 and the bearing 3 along its axial direction. A hole 9 is formed through the cam gear 6 in parallel to the axis of the camshaft 2, and a valve releasing lever 10 is rotatably mounted in the hole 9 at a shaft 11 thereof.

Figure 3:
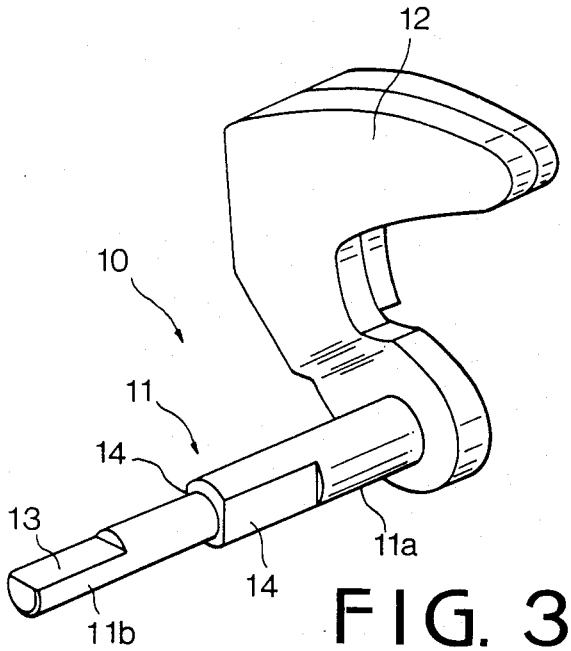
FIG. 3 is a perspective view of a releasing lever.
Figure 5:
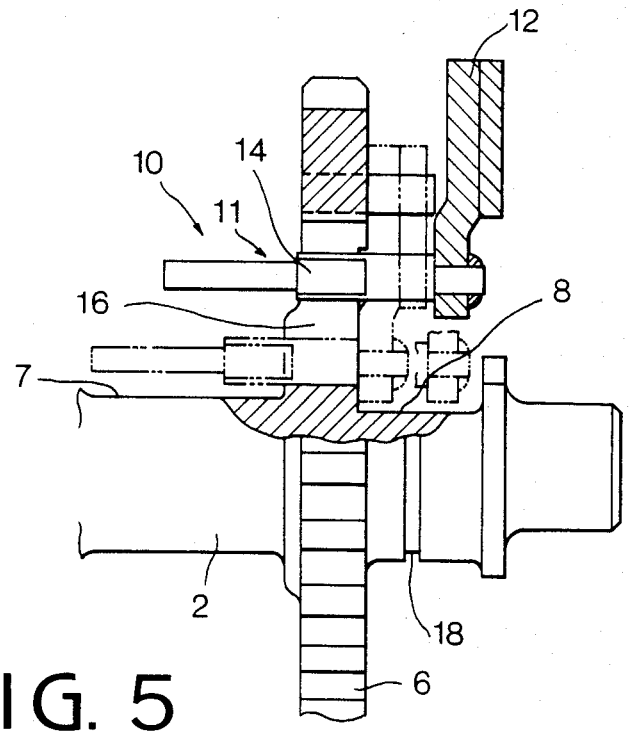
FIG. 5 is an illustration for explaining the attachment of the releasing lever.

As shown in FIG. 3, the releasing lever 10 has a weight 12 made from sheet metals attached on one end of the shaft 11 by welding. The shaft 11 comprises two cylindrical portions 11*a* and 11*b* of approximately same length, the portion 11*a* having a larger diameter than portion 11*b*. The free end of the portion 11*b* is cut away in the axial direction forming a flat reduced portion 13 which comes into a position facing the underside of the tappet 4 when assembled. Further, two flat reduced portions 14, 14 are formed in parallel to each other on the cylindrical portion 11*a*. The length of the cylindrical portion 11*a* except the reduced portions 14 is slightly larger than the width of the cam gear 6. The width between the two flat reduced portions 14 and 14 is substantially the same as the diameter of cylindrical portion 11*b*.

Figure 2:
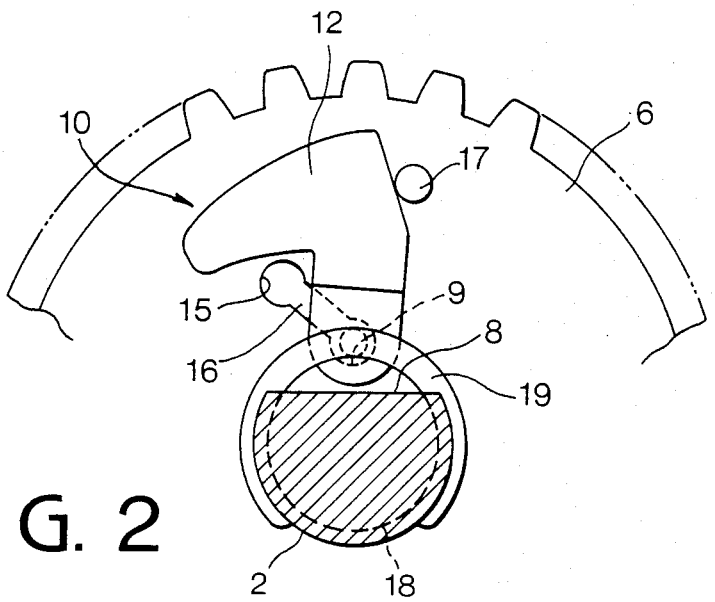
FIG. 2 is a sectional view taken along a line A—A of FIG. 1.
Figure 4:
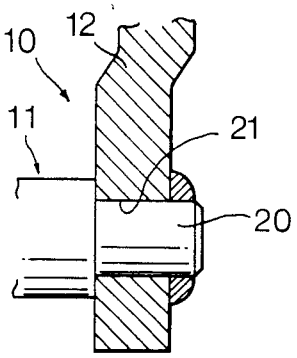
FIG. 4 is an enlarged view of a weight of the releasing lever shown in FIG. 3.

Another hole 15 is formed in the cam gear 6 at an outer position than the hole 9 and is connected to the hole 9 by a slit 16. The hole 15 has a diameter allowing the insertion of the shaft 11 and the slit 16 has a width enough for passing the shaft 11 at the flat reduced portions 14 therethrough. The relation between positions of slit 16 and reduced portions 14 are decided such that the reduced portions 14 engage with slit 16 at an angular position out of the operating angular range of the weight 12 between positions shown in FIGS. 6 and 7. A stopper pin 17 is provided to project from the end surface of the cam gear 6 as shown in FIG. 2, and to arrest the releasing lever 10 so that the rotary movement of the lever 10 is restricted when the centrifugal force is increased. As shown in FIG. 4, the shaft 11 has another end portion 20 which has a smaller diameter and is inserted through a hole 21 formed in the weight 12 of the releasing lever 10 and welded thereto.

The releasing lever 10 is easily assembled in the decompression device by following steps; inserting the end portion 11*b* of the shaft 11 in the hole 15; rotating the lever 10 so that the flat reduced portions 14 come to engage with the slit 16; sliding the flat portions 14 on the slit 16 towards the hole 9; further pushing the lever 10 in its axial direction so that the cylindrical portion 11*a* engages with the hole 9 and the weight 12 is closely positioned to the side of the cam gear 6 and the end portion 11*b* is positioned under the tappet 4; rotating the lever 10 to bring the weight 12 in the operating range; and engaging a snap ring 19 in an annular groove 18 formed on the camshaft, so that the snap ring 19 engages with the end of the shaft 11 to prevent the axial moving of the shaft 11. Accordingly, the releasing lever 10 is rotatably mounted in the hole 9, with facing the weight 12 to outer side of the cam gear 6. Since the diameter of the cylindrical portion 11*a* is larger than the width of the slit 16, the shaft 11 is held in the hole 9. Thus, the releasing lever 10 is prevented from removing from the gear 6.

Figure 6:
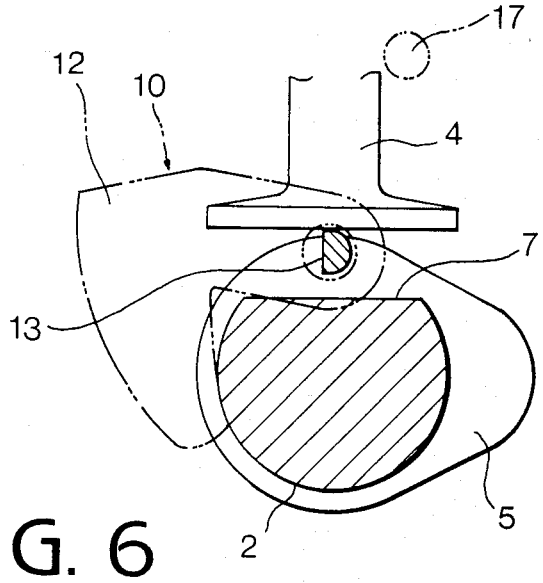
FIG. 6 is an enlarged sectional view taken along a line B—B of FIG. 1, explaining operation at the starting of engine.
Figure 7:
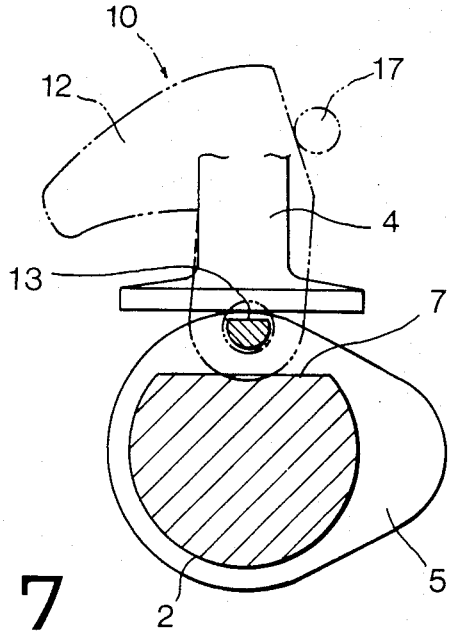
FIG. 7 is a similar view to FIG. 6 but explaining the operation during the ordinary running of the engine.

In operation, the releasing lever 10 is positioned as shown in FIG. 6 at starting operation of the engine, because the rotational speed of the camshaft 2 is low and the centrifugal force is small. In the state, the periphery of cylindrical portion 11*b* of the shaft 11 protrudes from the actuating periphery of the cam 5, thereby raising the tappet 4. Thus, the pressure in a combustion chamber (not shown) is kept at a low value.

When the speed of the camshaft 2 increases after the engine is started, the centrifugal force increases. Accordingly, the releasing lever 10 rotates in the clockwise direction in FIG. 6 until it comes to a position shown in FIG. 7. In the position, the flat reduced portion 13 of the cylindrical portion 11*b* is positioned below the periphery of the cam 5, releasing the tappet 4. As a result, the tappet 4 engages with the cam 5, so that the pressure in the combustion chamber increases to normally operate the engine.

According to the decompression device of the present invention as explained above, the releasing lever has a reduced portion which can be slided through a slit formed between two holes, so that the releasing lever can be easily positioned in place passing through the slit.

While the presently referred embodiment of the present invention has been shown and described, it is to be understood that this disclosure is for the purpose of illustration and that various changes and modifications may be made without departing from the scope of the invention as set forth in the appended claims.

What is claimed is:

1. In a decompression apparatus for an engine having a camshaft, a cam gear formed on the camshaft, and a tappet engaging with a cam on the camshaft, the improvement comprising;

a releasing lever comprising a shaft and a weight secured to the shaft, the shaft having a large diameter portion to which the weight is secured, reduced portion formed in the large diameter portion, small diameter portion adjacent the reduced portion, flat reduced portion formed in an end portion of the small diameter portion;

the cam gear having a first hole in which the large diameter portion is rotatably mounted, second hole in which the reduced portion and small diameter portion can be inserted, slit connecting both the first and second holes and having a width for allowing the reduced portion of the large diameter portion to pass the slit; and means for fixing the releasing lever to the cam gear so as to prevent the axial movement of the releasing lever, the flat reduced portion being arranged to locate below the periphery of the cam at the stop of the engine operation.

2. The apparatus according to claim 1 wherein the reduced portion comprises a pair of flat portions which are parallel to each other.

3. The apparatus according to claim 1 wherein the means is a snap ring engaged with an annular groove formed on a periphery of the camshaft.

* * * * *